US009184544B2

(12) United States Patent
Sasano et al.

(10) Patent No.: US 9,184,544 B2
(45) Date of Patent: Nov. 10, 2015

(54) GROUND TERMINAL AND CONNECTOR PROVIDED THEREWITH

(71) Applicant: OMRON CORPORATION, Kyoto-shi (JP)

(72) Inventors: Naoya Sasano, Hachioji (JP); Hirokazu Hoshino, Tokorozawa (JP)

(73) Assignee: OMRON Corporation, Kyoto (JP)

( * ) Notice: Subject to any disclaimer, the term of this patent is extended or adjusted under 35 U.S.C. 154(b) by 14 days.

(21) Appl. No.: 14/087,178

(22) Filed: Nov. 22, 2013

(65) Prior Publication Data

US 2014/0141634 A1 May 22, 2014

(30) Foreign Application Priority Data

Nov. 22, 2012 (JP) ..... 2012-256479

(51) Int. Cl.

| | |
|---|---|
| ***H01R 4/66*** | (2006.01) |
| ***H01R 13/652*** | (2006.01) |
| ***H01R 13/6595*** | (2011.01) |
| *H01R 12/70* | (2011.01) |
| *H01R 13/426* | (2006.01) |
| *H01R 13/627* | (2006.01) |
| *H01R 24/86* | (2011.01) |

(52) U.S. Cl.
CPC ..... *H01R 13/652* (2013.01); *H01R 13/6595* (2013.01); *H01R 12/707* (2013.01); *H01R 13/426* (2013.01); *H01R 13/6273* (2013.01); *H01R 24/86* (2013.01)

(58) Field of Classification Search
CPC ..... H01R 13/65802; H01R 24/50; H01R 13/6273; H01R 13/748; H01R 12/707
USPC ..... 439/108
See application file for complete search history.

(56) References Cited

U.S. PATENT DOCUMENTS

| | | | | |
|---|---|---|---|---|
| 5,145,412 | A | 9/1992 | Tan et al. | |
| 5,326,280 | A | 7/1994 | Briones et al. | |
| 5,482,477 | A | 1/1996 | Michael | |
| 6,203,362 | B1 * | 3/2001 | Tsuji | 439/470 |
| 6,364,693 | B1 * | 4/2002 | Stagg et al. | 439/467 |
| 6,475,021 | B1 * | 11/2002 | Tan et al. | 439/446 |
| 7,004,783 | B2 * | 2/2006 | Kumamoto et al. | 439/470 |
| 7,014,480 | B1 | 3/2006 | Weidner et al. | |
| 7,168,987 | B1 * | 1/2007 | Morohoshi et al. | 439/607.18 |
| 7,247,052 | B2 | 7/2007 | Sofker | |
| 7,413,473 | B2 * | 8/2008 | Wu | 439/557 |

(Continued)

FOREIGN PATENT DOCUMENTS

| | | | | |
|---|---|---|---|---|
| DE | 202010009598 U1 | 9/2010 | | |
| EP | 1 107 131 A2 * | 5/2000 | | H01R 13/646 |
| EP | 1501171 | 1/2005 | | |

OTHER PUBLICATIONS

European Search Report for corresponding application EP13194078 mail date Feb. 17, 2014.

*Primary Examiner* — Jean F Duverne
(74) *Attorney, Agent, or Firm* — Klarquist Sparkman, LLP

(57) ABSTRACT

A ground terminal and a connector provided therewith where the ground terminal includes a terminal portion that is electrically connected to an outside device and elastic arms that extend in an identical direction from both ends of a central coupling portion, where a pair of latching pawls is provided in at least one of an inner circumferential edge of the central coupling portion and inner circumferential edges of the elastic arms.

16 Claims, 15 Drawing Sheets

(56) References Cited

U.S. PATENT DOCUMENTS 7,628,650 B2 * 12/2009 Aoki et al. ..... 439/607.28
2003/0094299 A1 5/2003 Lee
2007/0224883 A1 9/2007 Chan et al.
2011/0021042 A1 1/2011 Weidner et al.

* cited by examiner

GROUND TERMINAL AND CONNECTOR PROVIDED THEREWITH

CROSS REFERENCE TO RELATED APPLICATION

This application is related to and claims the benefit of Japanese Patent Application Number 2012-256479 filed on 22 Nov. 2012, the contents of which are herein incorporated by reference in their entirety.

BACKGROUND OF THE INVENTION

1. Technical Field

The present invention relates to a ground terminal, particularly to a ground terminal assembled in a connector.

2. Related Art

Conventionally, in an annular ground terminal connected to a connector, a metallic outer shell of the connector is connected to a printed board by the annular ground terminal in order to prevent an adverse effect on a signal transmitted through the connector (see, for example, U.S. Pat. No. 7,247,052).

However, as illustrated in FIGS. 2 and 3 in the '052 patent, the annular ground terminal has a structure in which electric connection is established while the connector is fitted in the annular ground terminal previously mounted on the printed board. Therefore, unfortunately a wide installation area is required when the annular ground terminal is assembled in the printed board, integrated density is lowered, a cutting layout is degraded, the shape is complicated, and the production is not easily performed.

SUMMARY OF INVENTION

The present invention has been devised to solve the problems described above, and provides an easy-to-produce ground terminal having a small installation area and a good cutting layout and a connector provided therewith.

In accordance with one aspect of the present invention, a ground terminal includes: a terminal portion configured to be electrically connected to an outside device; and elastic arms configured to extend in an identical direction from both ends of a central coupling portion, where a pair of latching pawls is provided in at least one of an inner circumferential edge of the central coupling portion and inner circumferential edges of the elastic arm. The invention also provides a connector incorporating the described ground terminal.

BRIEF DESCRIPTION OF THE DRAWINGS

FIG. 1 illustrates a connector in which a ground terminal according to a first embodiment of the present invention is assembled.

FIG. 2 illustrates a state in which the connector in FIG. 1 is attached to a printed board.

FIG. 7 illustrates a ground terminal according to a second embodiment of the present invention.

FIG. 8 illustrates a method for assembling the ground terminal in FIG. 7 in the connector.

FIG. 9 illustrates a ground terminal according to a third embodiment of the present invention.

FIG. 10 illustrates a method for assembling the ground terminal in FIG. 9 in the connector.

FIG. 11 illustrates a ground terminal according to a fourth embodiment of the present invention.

FIG. 12 illustrates a method for assembling the ground terminal in FIG. 11 in the connector.

FIG. 13 illustrates a ground terminal assembled in a connector according to a fifth embodiment of the present invention.

FIG. 14 illustrates the ground terminal of the fifth embodiment according to the present invention, FIG. 15 illustrates a method for assembling the ground terminal in FIG. 14 in the connector.

DETAILED DESCRIPTION

Figure 1A:
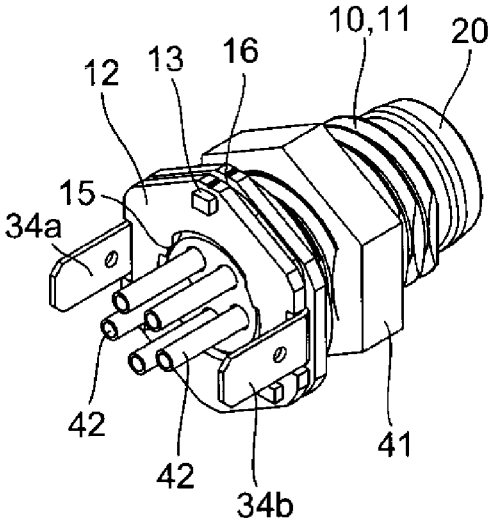
FIGS. 1A, 1B, 1C, 1D, and 1E are a perspective view, a different-angle perspective view, a plan view, a front view, and a right side view of the connector, respectively.
Figure 1B:
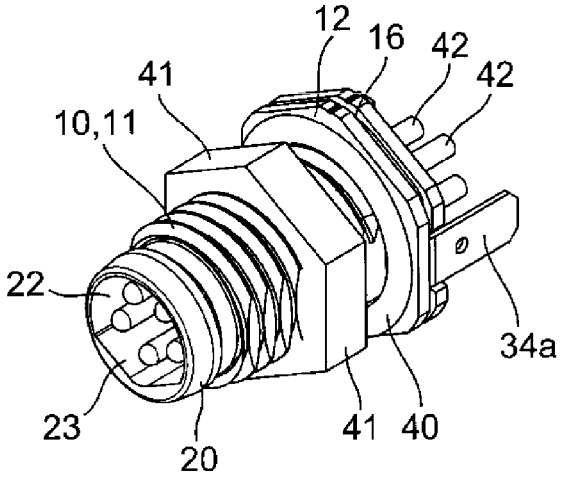
Figure 1C:
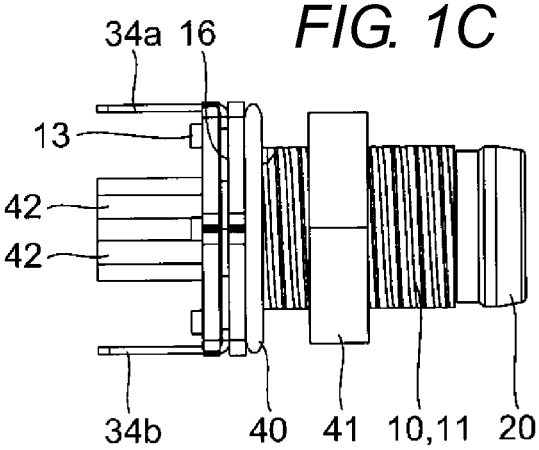
Figure 1D:
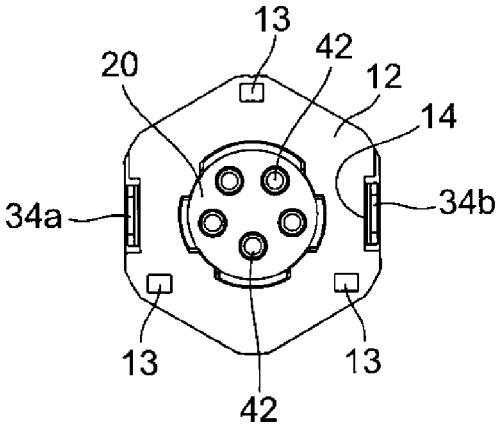
Figure 1E:
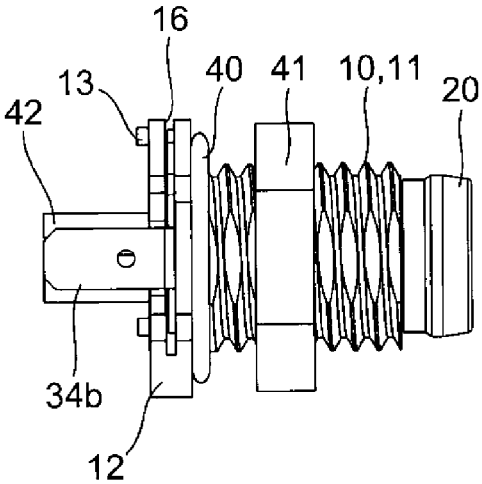
Figure 2A:
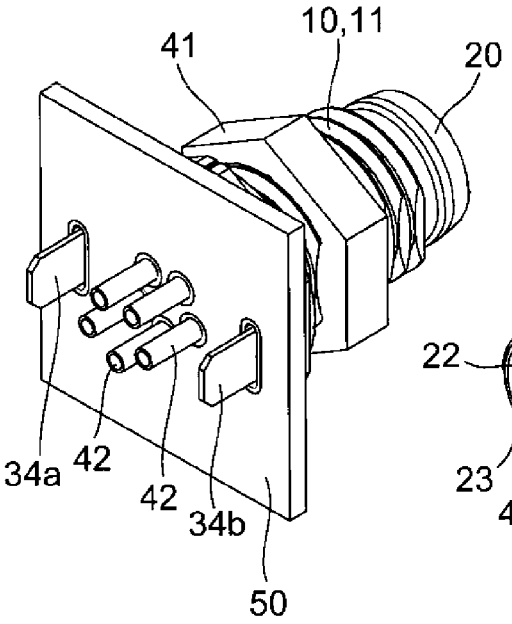
FIGS. 2A, 2B, 2C, 2D, and 2E are a perspective view, a different-angle perspective view, a plan view, a front view, and a right side view of the connector attached to the printed board, respectively.
Figure 2B:
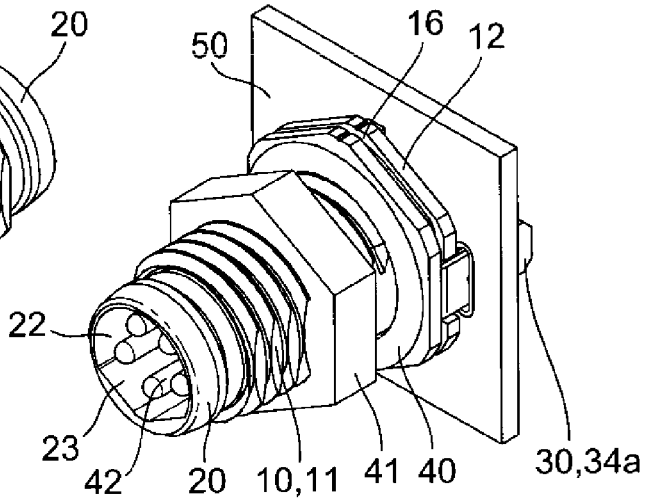
Figure 2C:
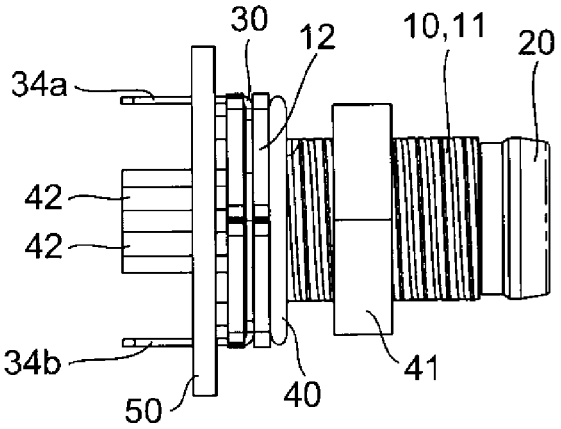
Figure 2D:
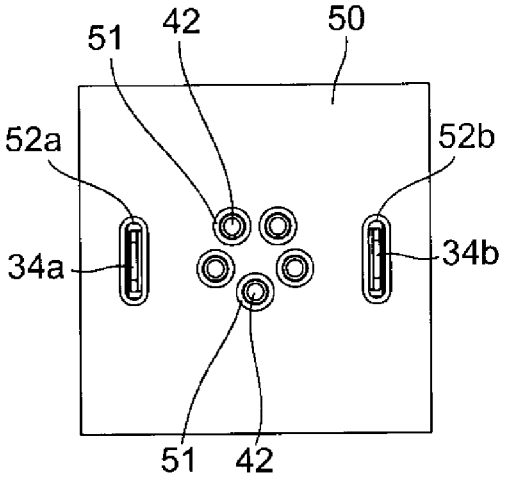
Figure 2E:
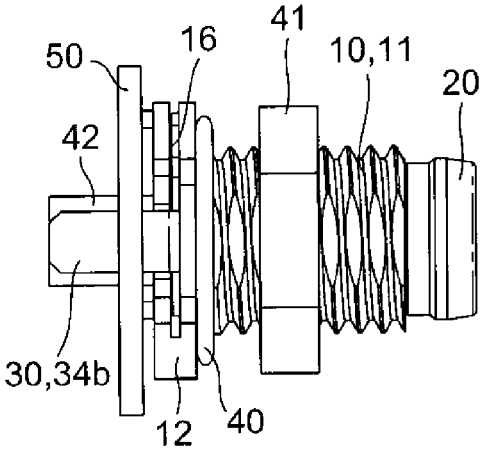

Hereinafter, ground terminals according to the present invention and connectors in which the ground terminals are assembled will be described with reference to the drawings of FIGS. 1 to 15.

As illustrated in FIGS. 1 to 6, a connector in which a ground terminal according to a first embodiment is assembled roughly includes a connector body 10, a support 20 assembled in the connector body 10, a ground terminal 30 attached to the connector body 10, a sealing external O-ring 40 assembled in an outer circumferential surface of the connector body 10, and a nut 41 engaged with an external thread of the connector.

Figure 3:
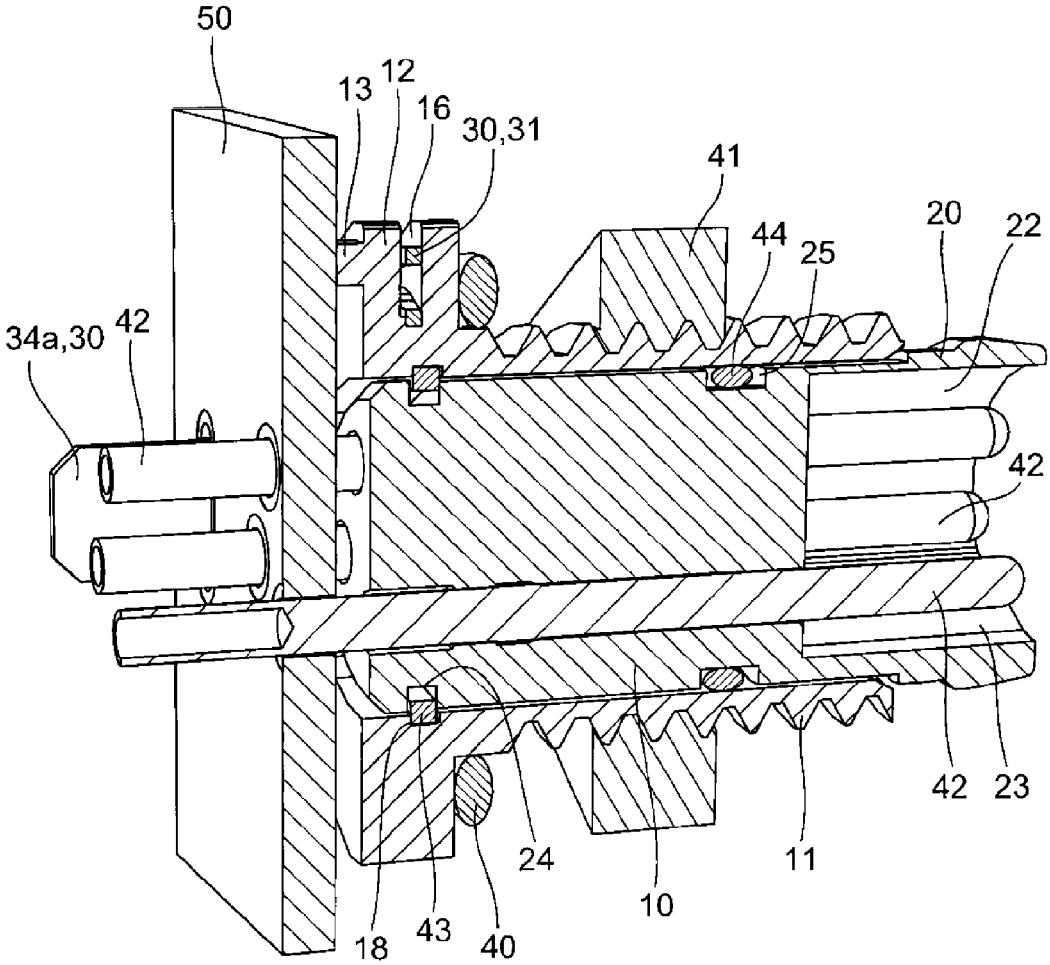
FIG. 3 is a longitudinal sectional perspective view illustrating the connector in FIG. 2A.
Figure 4:
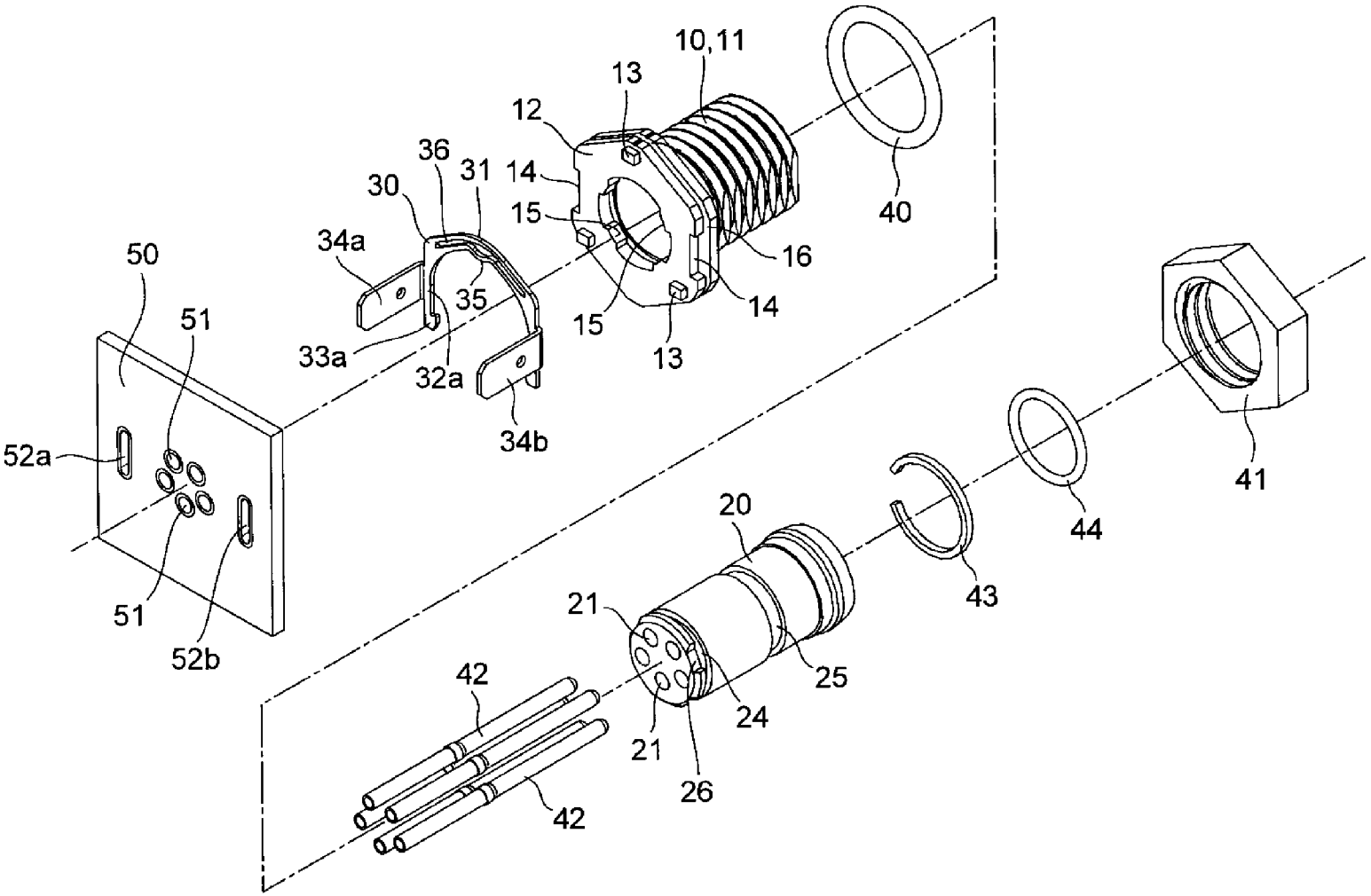
FIG. 4 is an exploded perspective view of the connector in FIG. 2A.
Figure 5A:
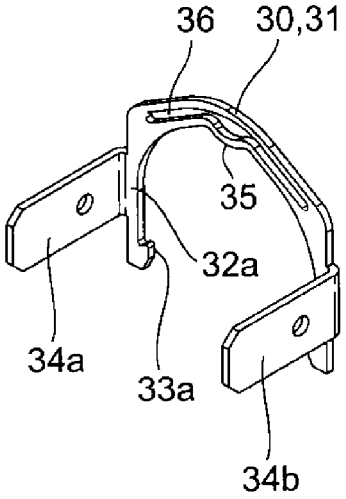
FIG. 5 illustrates the ground terminal in FIG. 4, and FIGS. 5A, 5B, 5C, 5D, and 5E are a perspective view, a different-angle perspective view, a plan view, a front view, and a right side view of the connector of the ground terminal, respectively.
Figure 5B:
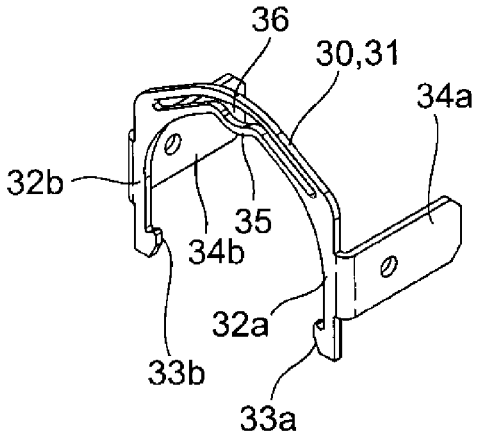
Figure 5C:
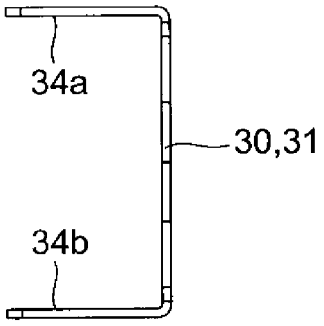
Figure 5D:
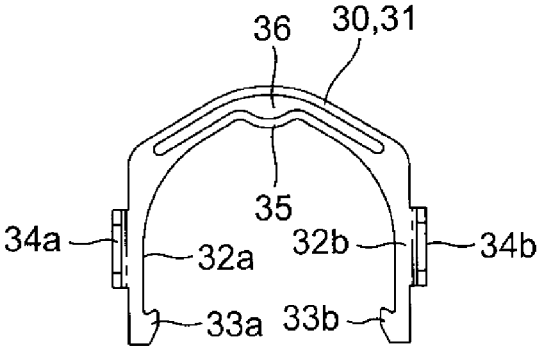
Figure 5E:
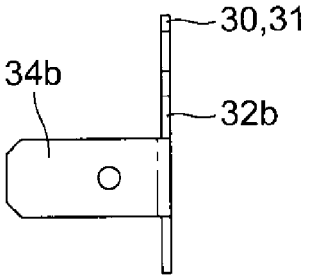
Figure 6A:
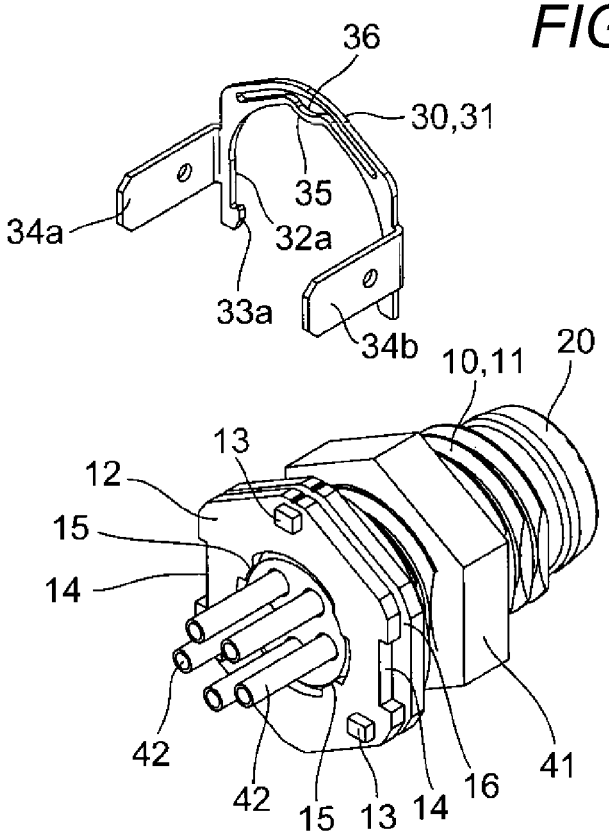
FIG. 6 illustrates a method for assembling the ground terminal in the connector in FIG. 1, and FIGS. 6A, 6B, and 6C are a perspective view before the assembly, a partially sectional perspective view before the assembly, and a partially sectional perspective view after the assembly, respectively.
Figure 6B:
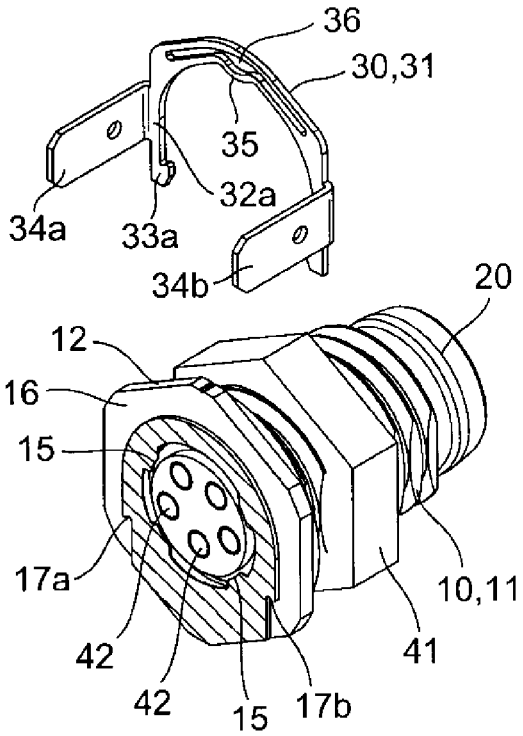
Figure 6C:
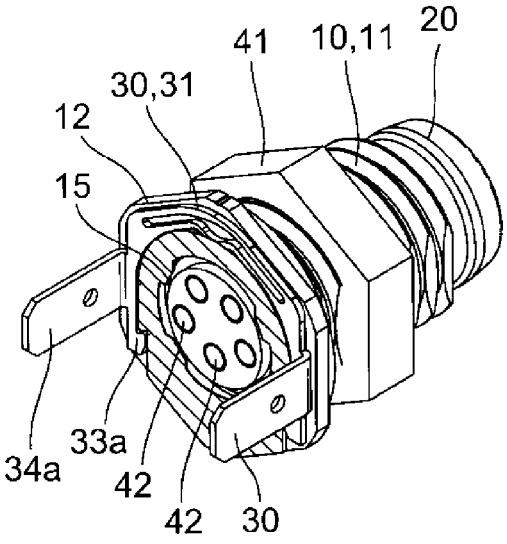
Figure 7A:
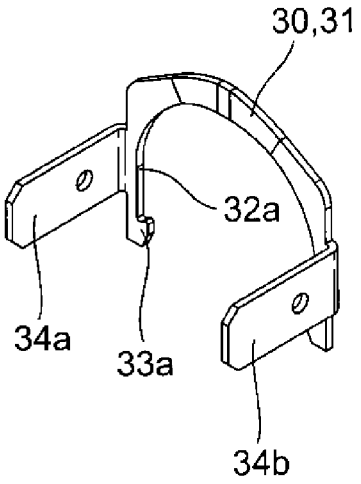
FIGS. 7A, 7B, 7C, 7D, and 7E are a perspective view, a different-angle perspective view, a plan view, a front view, and a right side view of the ground terminal, respectively.
Figure 7B:
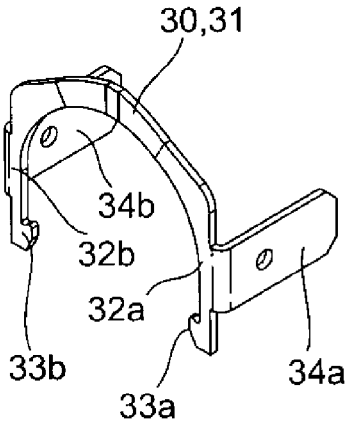
Figure 7C:
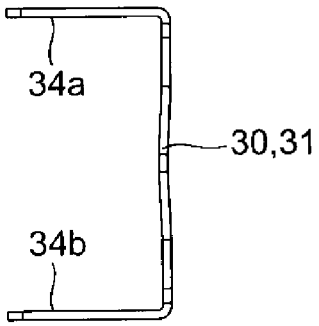
Figure 7D:
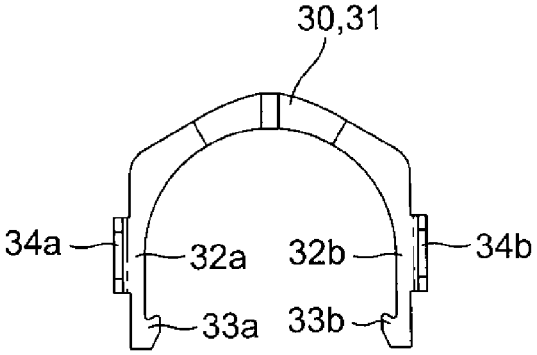
Figure 7E:
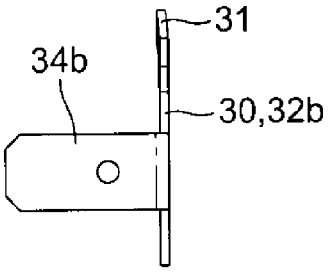

As illustrated in FIG. 4, the connector body 10 is a metallic cylinder including an external thread 11 on the outer circumferential surface thereof, and a guard portion 12 is provided in one end portion of the connector body 10. In the guard portion 12, standoffs 13 are projected at predetermined intervals in an outward surface edge portion. The standoffs 13 are members provided to separate the connector body 10 from a printed board 50 described later with a predetermined distance. Notches 14 with which terminal portions 34*a* and 34*b* of the ground terminal 30 engage are formed in both side edge portions in a front surface of the guard portion 12. Position regulating projections 15 that regulate a position of the support 20 are formed at predetermined intervals at an opening edge exposed from the guard portion 12. As illustrated in FIG. 6, in the guard portion 12, an engagement groove 16 having a substantial U-shape in section is formed along an outer circumferential end face, and a pair of latch receiving portions 17*a* and 17*b* in which latching pawls 33*a* and 33*b* of the ground terminal 30 can be latched is formed in a bottom surface of the engagement groove 16. As illustrated in FIG. 3, a positioning annular groove portion 18 is formed along an inner circumferential surface of the connector body 10.

The support 20 is a substantially columnar resin molding product that can be inserted in the connector body 10, plural pin terminal holes 21 in each of which a pin terminal 42 can be inserted are made in parallel with an axial center, and a plug recess 22 (FIGS. 2B and 3) in which a plug (not illustrated) is fitted is formed on one end side of the support 20. A substantial V-shape position regulating step portion 23 (FIG. 2B) is formed in the plug recess 22. A first engagement groove 24 is formed on one end side in the outer circumferential surface of the support 20 in order to engage with a positioning C-ring 43, and a second engagement groove 25 is formed in a substantially central portion in the outer circumferential surface of the support 20 in order to elastically engage with a sealing internal O-ring 44. A position regulating receiving portion 26 is notched on the other end side of the support 20

As illustrated in FIG. 5, a conductive elastic plate material is punched and pressed into the ground terminal 30, and latching pawls 33*a* and 33*b* are provided at leading ends of elastic arms 32*a* and 32*b* that extend from both sides of the central coupling portion 31. The terminal portions 34*a* and 34*b* extend from outside edge portions of the elastic arms 32*a* and 32*b* in parallel with the axial center direction. In the central coupling portion 31, a slit 36 is formed along a longitudinal-and-latitudinal direction, and an inner circumferential edge portion is bent to provide a projection 35.

As illustrated in FIG. 4, in the printed board 50 to which the connector having the above configuration is connected, signal terminal holes 51 are concentrically made at equal intervals, and ground terminal holes 52*a* and 52*b* are made on both sides of the signal terminal holes 51. The signal terminal holes 51 may electrically be connected to each other as needed basis.

A method for assembling the connector will be described below.

The pin terminal 42 is inserted in the pin terminal hole 21 of the support 20 to project one end of the pin terminal 42 into the plug recess 22 (FIG. 3), and the positioning C-ring 43 and the sealing internal O-ring 44 are placed on the first and second engagement grooves 24 and 25, respectively. The support 20 is inserted in the connector body 10, whereby the positioning C-ring 43 engages with the positioning annular groove portion 18, which is provided in the inner circumferential surface of the connector body 10, and is placed at a predetermined position. The sealing internal O-ring 44 is pressed against the inner circumferential surface of the connector body 10 to form a sealing structure. The position regulating receiving portion 26 of the support 20 engages with the position regulating projection 15 provided in the connector body 10, thereby preventing rotation of the support 20.

As illustrated in FIG. 6, the elastic arms 32*a* and 32*b* of the ground terminal 30 are inserted and assembled in the engagement groove 16 provided in the guard portion 12 of the connector body 10. Therefore, the projection 35 is elastically deformed by abutting on the bottom surface of the engagement groove 16, and the latching pawls 33*a* and 33*b* provided in the elastic arms 32*a* and 32*b* are latched and prevented from disengagement in the latch receiving portion 17*a* and 17*b* of the connector body 10. The terminal portions 34*a* and 34*b* provided in the elastic arms 32*a* and 32*b* engage with the notches 14 provided in the guard portion 12 to regulate the positions of the terminal portions 34*a* and 34*b*, and the assembly of the connector is completed (FIG. 1A). At this point, in the first embodiment, a repulsive force of the projection 35 applies a force in the direction separating from the bottom surface of the engagement groove 16, and the force acts in the direction in which a distance between the latching pawls 33*a* and 33*b* is narrowed through the central coupling portion 31 and the elastic arms 32*a* and 32*b*. The ground terminal 30 is prevented from disengagement in the connector body 10 at three points, namely, the pair of latching pawls 33*a* and 33*b* and the projection 35, thereby obtaining a support structure having a resistance to a disturbance such as a vibration.

As illustrated in FIG. 2, the assembly work is completed by inserting the pin terminals 42 and the terminal portions 34*a* and 34*b* of the ground terminal 30, which project from the connector, in the signal terminal holes 51 and the ground terminal holes 52*a* and 52*b*, which are made in the printed board 50 and soldering them.

Finally, one end portion of the connector is inserted in an attaching hole made in a housing of an electric instrument (not illustrated), and the external thread 11 of the projected connector body 10 is screwed with the nut 41 to be able to fix the connector to the housing of the electric instrument. The other end portion of the pin terminal 42 is connected to a lead wire (not illustrated), and the plug (not illustrated) is fitted in the plug recess 22 of the support 20 to complete the connection work.

Figure 8A:
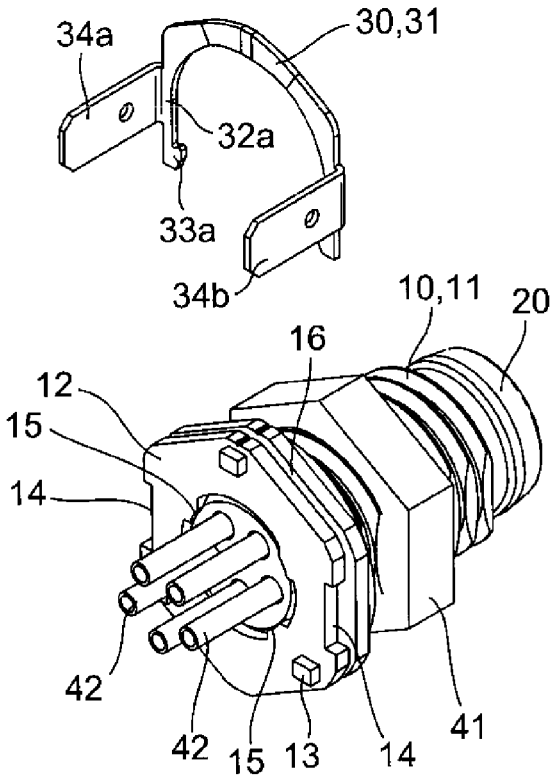
FIGS. 8A, 8B, and 8C are a perspective view before the assembly, a partially sectional perspective view before the assembly, and a partially sectional perspective view after the assembly, respectively.
Figure 8B:
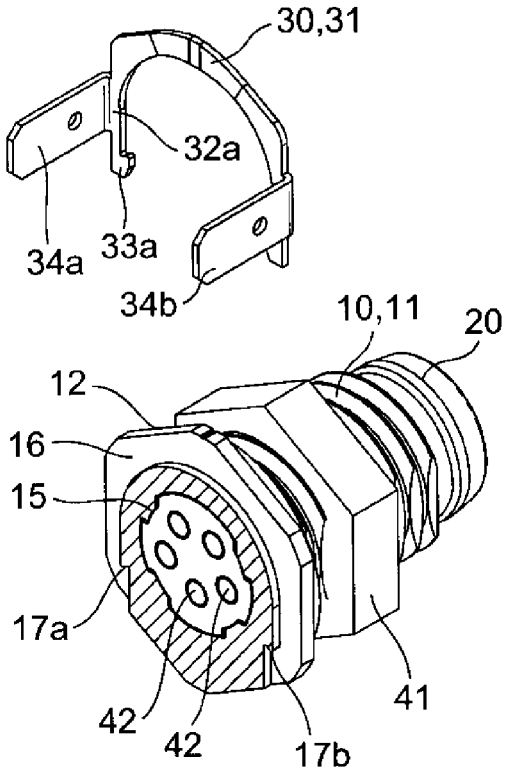
Figure 8C:
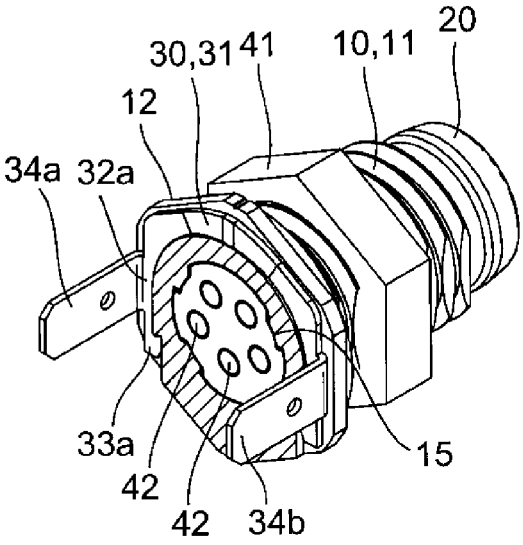
Figure 9A:
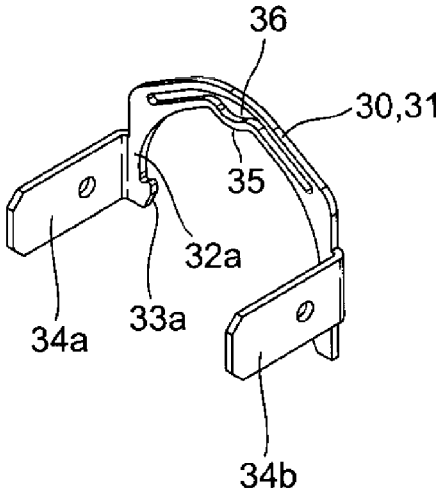
FIGS. 9A, 9B, 9C, 9D, and 9E are a perspective view, a different-angle perspective view, a plan view, a front view, and a right side view of the ground terminal, respectively.
Figure 9B:
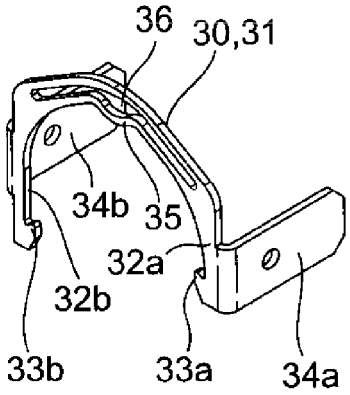
Figure 9C:
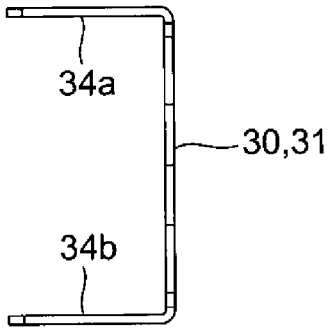
Figure 9D:
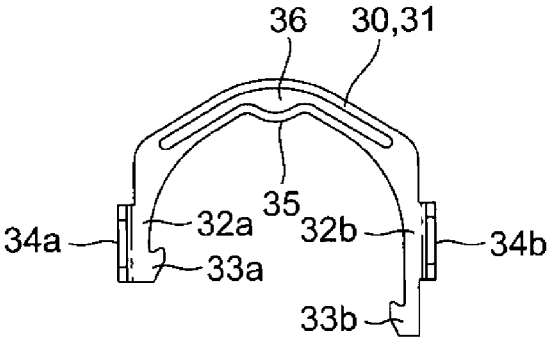
Figure 9E:
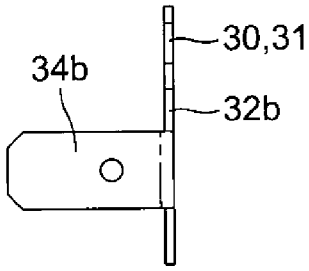

As illustrated in FIGS. 7 and 8, a second embodiment is substantially similar to those of the first embodiment, and differs from the first embodiment in that the projection and the slit are not provided but a continuous arc is formed by the central coupling portion 31 and the inner circumferential edge portions of the elastic arms 32*a* and 32*b*.

The central coupling portion 31 is slightly curved by performing press working in a plate thickness direction. This is because dropout is prevented due to the vibration by press-fitting the central coupling portion 31 in the engagement groove 16 provided in the guard portion 12 of the connector body 10.

According to the second embodiment, the connector, in which the central coupling portion 31 has large mechanical strength while the ground terminal 30 has the large retaining force, is advantageously obtained.

Because other configurations are substantially similar to those of the first embodiment, the identical component is designated by the identical numeral and the description is omitted.

Figure 10A:
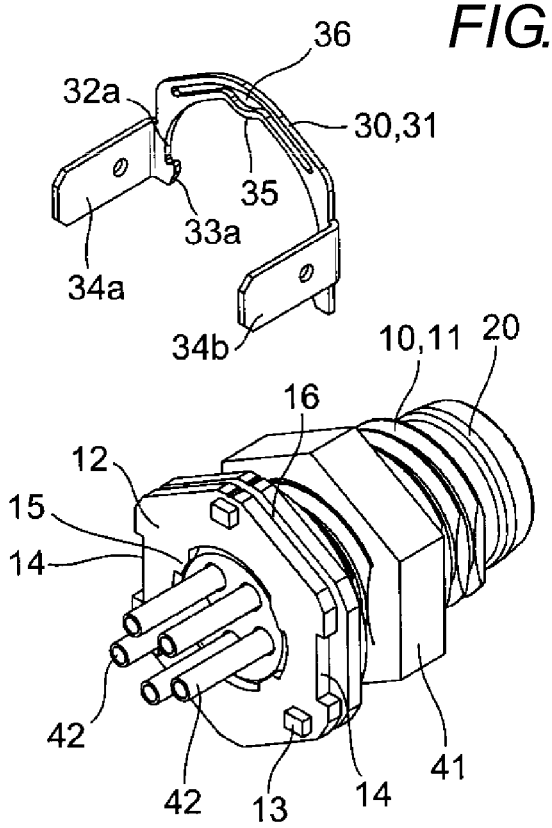
FIGS. 10A, 10B, and 10C are a perspective view before the assembly, a partially sectional perspective view before the assembly, and a partially sectional perspective view after the assembly, respectively.
Figure 10B:
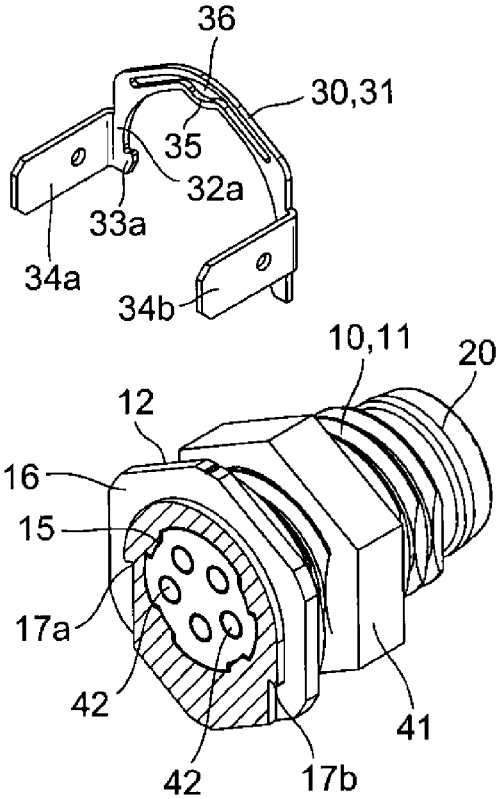
Figure 10C:
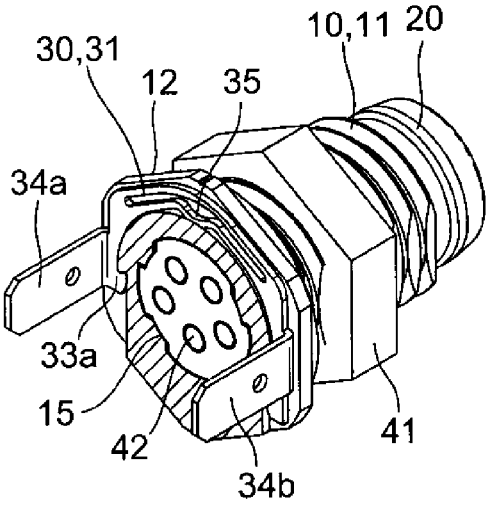
Figure 11A:
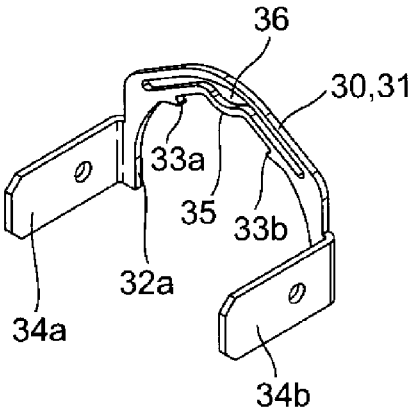
FIGS. 11A, 11B, 11C, 11D, and 11E are a perspective view, a different-angle perspective view, a plan view, a front view, and a right side view of the ground terminal, respectively.
Figure 11B:
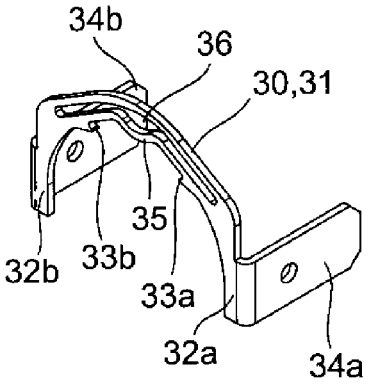
Figure 11C:
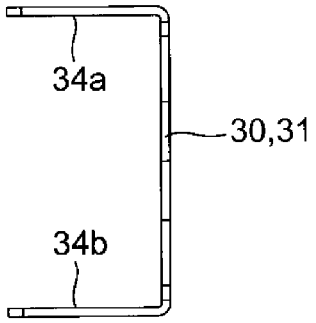
Figure 11D:
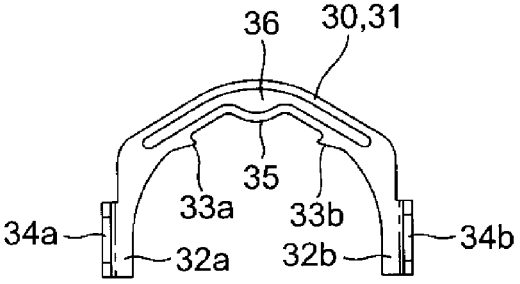
Figure 11E:
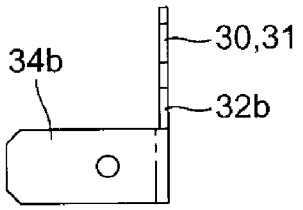

As illustrated in FIGS. 9 and 10, a third embodiment is substantially similar to those of the first embodiment, and differs from the first embodiment in that lengths of pair of elastic arms 32*a* and 32*b* differ from each other.

According to the third embodiment, because the latching pawl 33*a* having the shorter elastic arm 32*a* can be latched after the latching pawl 33*b* having the longer elastic arm 32*b* is latched, advantageously the work to assemble the ground terminal 30 is further facilitated to obtain the connector with high-productivity.

Because other configurations are substantially similar to those of the first embodiment, the identical component is designated by the identical numeral and the description is omitted.

Figure 12A:
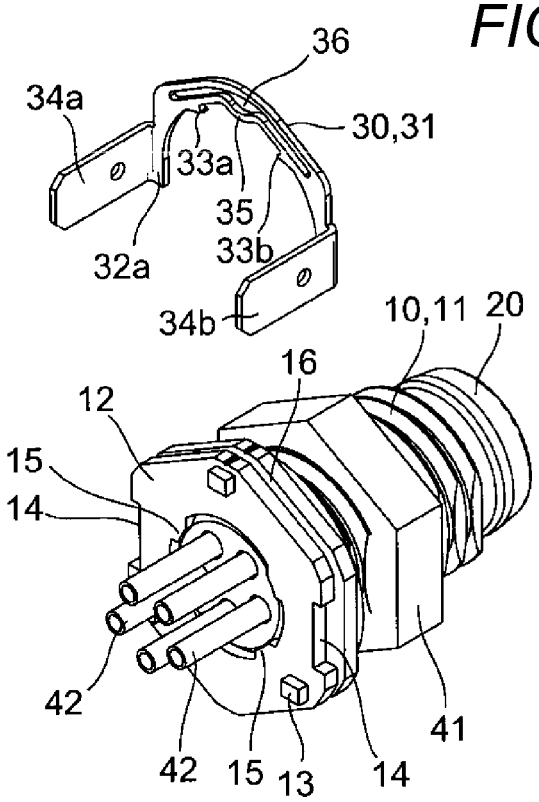
FIGS. 12A, 12B, and 12C are a perspective view before the assembly, a partially sectional perspective view before the assembly, and a partially sectional perspective view after the assembly, respectively.
Figure 12B:
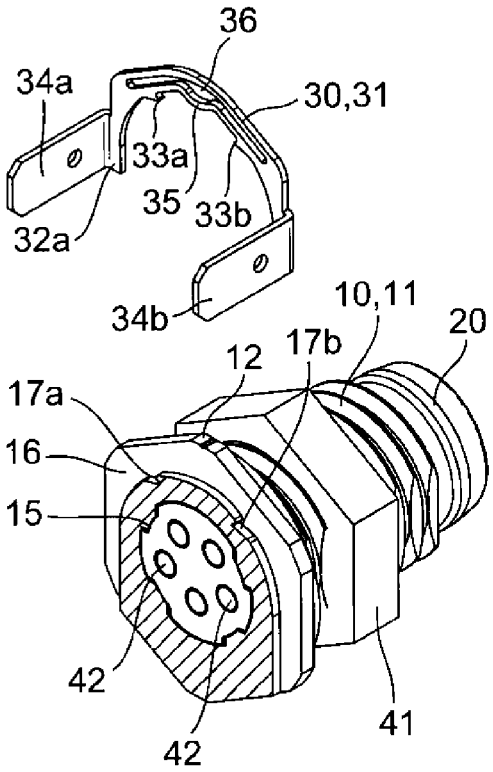
Figure 12C:
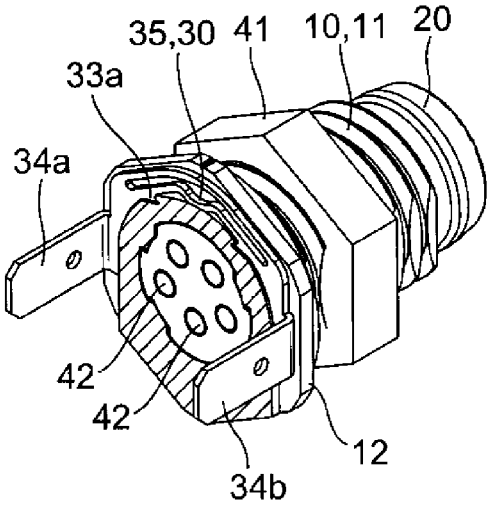
Figure 13A:
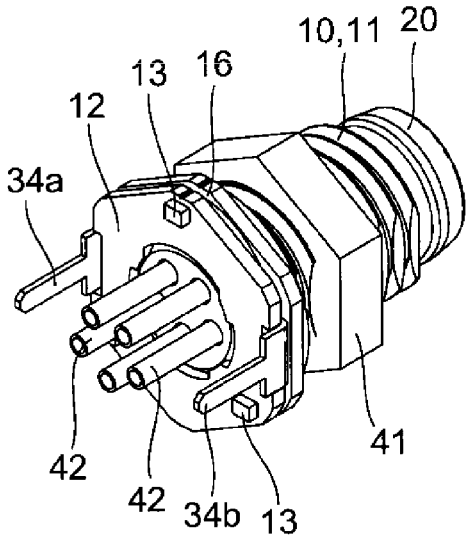
FIGS. 13A, 13B, 13C, 13D, and 13E are a perspective view, a different-angle perspective view, a plan view, a front view, and a right side view of the ground terminal, respectively.
Figure 13B:
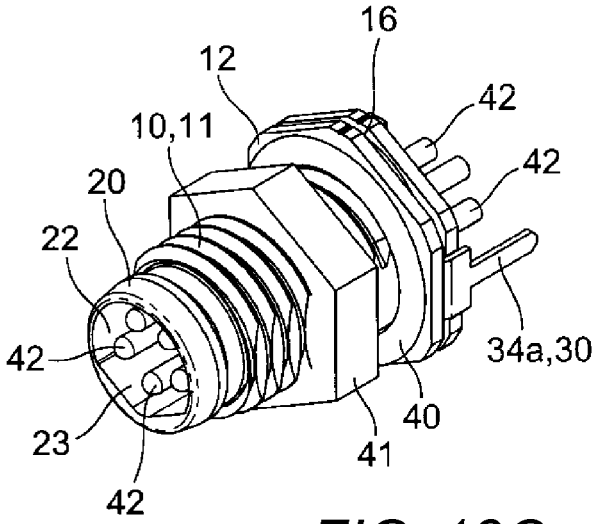
Figure 13C:
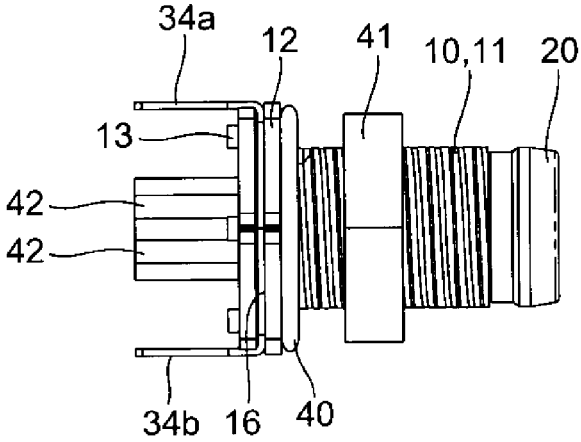
Figure 13D:
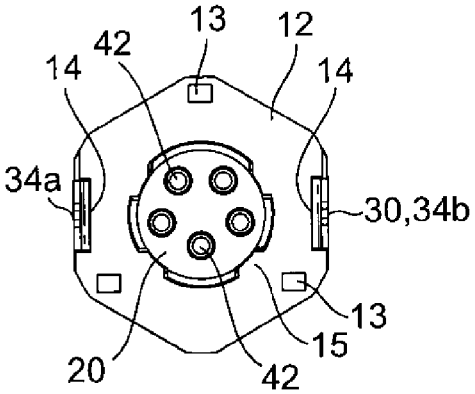
Figure 13E:
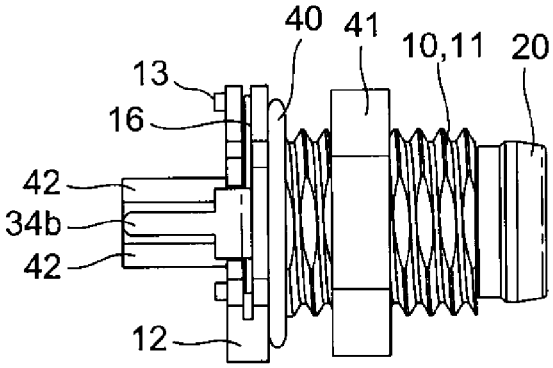
Figure 14A:
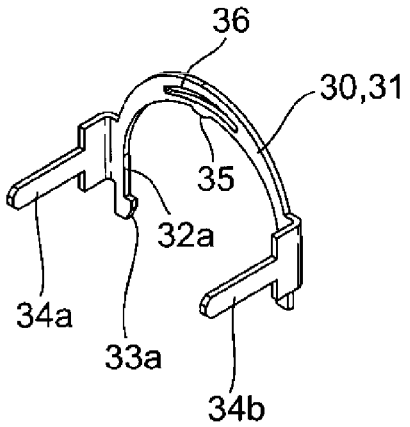
FIGS. 14A, 14B, 14C, 14D, and 14E are a perspective view, a different-angle perspective view, a plan view, a front view, and a right side view of the ground terminal, respectively.
Figure 14B:
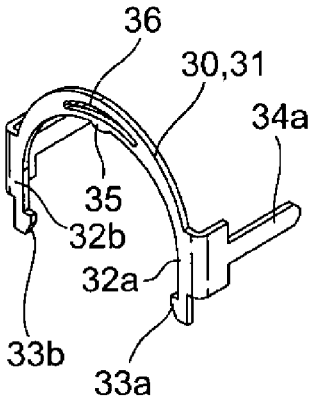
Figure 14C:
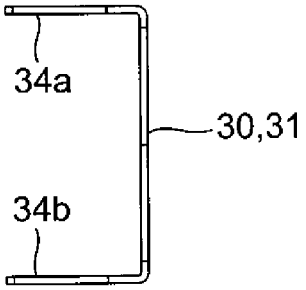
Figure 14D:
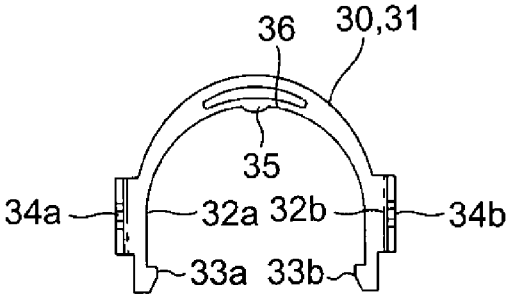
Figure 14E:
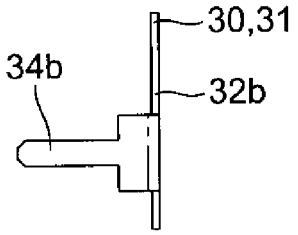

As illustrated in FIGS. 11 and 12, a fourth embodiment is substantially similar to those of the first embodiment, and differs from the first embodiment in that the latching pawls are not provided in the leading end portions of the elastic arms 32*a* and 32*b* but the latching pawls 33*a* and 33*b* are provided on both sides of the projection 35 in the inner circumferential edge of the central coupling portion 31.

According to the fourth embodiment, advantageously a connector with high-productivity is obtained because the distance necessary to assemble the ground terminal 30 is shortened to facilitate the assemble work.

Because other configurations are substantially similar to those of the first embodiment, the identical component is designated by the identical numeral and the description is omitted.

Figure 15A:
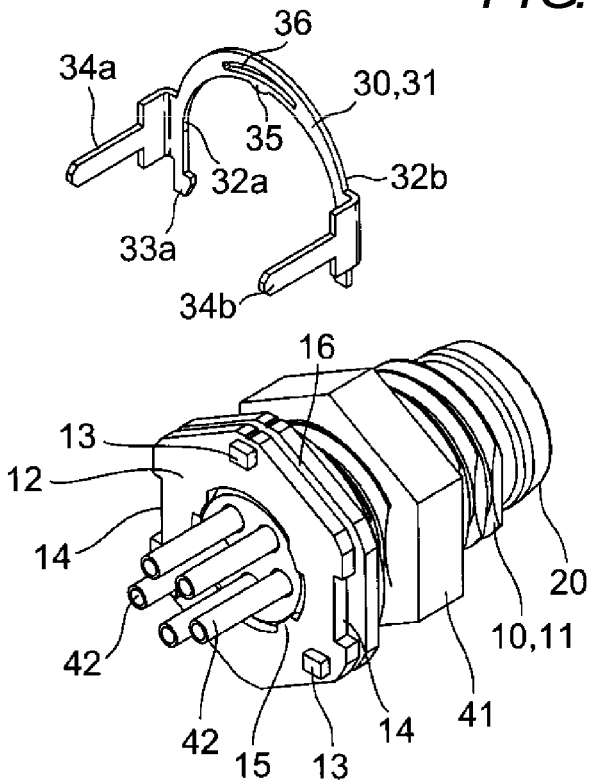
FIGS. 15A, 15B, and 15C are a perspective view before the assembly, a partially sectional perspective view before the assembly, and a partially sectional perspective view after the assembly, respectively.
Figure 15B:
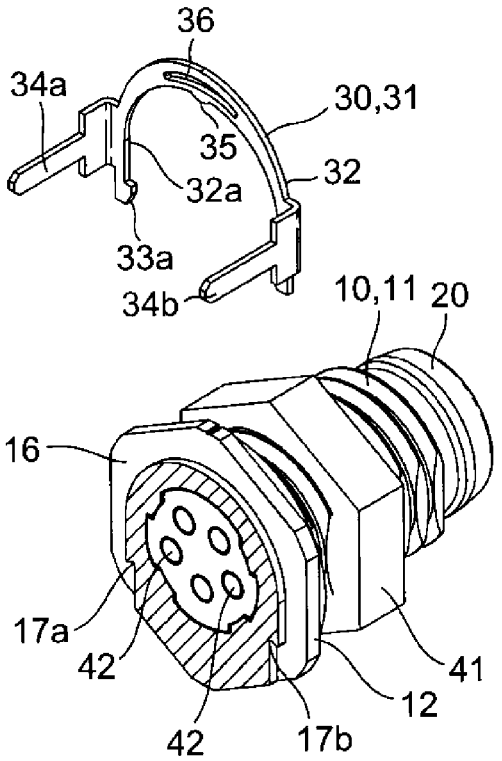
Figure 15C:
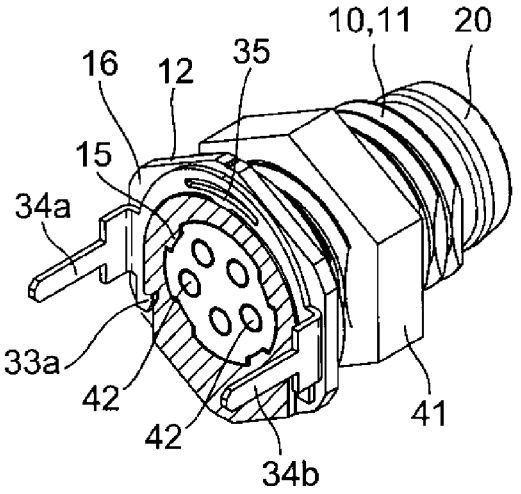

As illustrated in FIGS. 13 to 15, a fifth embodiment is substantially similar to those of the first embodiment, and differs from the first embodiment in the following points. That is, the continuous arc is formed by the central coupling portion 31 and the inner circumferential edge portions of the elastic arms 32*a* and 32*b*, the projection 35 projects in the inner circumferential edge of the central coupling portion 31, short slit 36 is formed, and the terminal portions 34*a* and 34*b* are formed into a rod shape.

According to the fifth embodiment, advantageously the terminal portion can be selected from various shapes to enhance a design degree of freedom.

In the above embodiments, the ground terminal 30 is prevented from disengagement in the connector body 10 with the latching pawl interposed therebetween. Alternatively, the ground terminal 30 may be prevented from disengagement by press-fitting.

The present invention is not limited to the above ground terminal and connector, but the present invention may be applied to ground terminals and connectors having other shapes.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment

What is claimed is:

1. A ground terminal comprising:

a terminal portion configured to be electrically connected to an outside device; and elastic arms configured to extend in an identical direction from both ends of a central coupling portion, wherein a pair of latching pawls is provided in at least one of an inner circumferential edge of the central coupling portion and inner circumferential edges of the elastic arms; and wherein a slit is provided along a longitudinal-and-latitudinal direction of the central coupling portion.

2. The ground terminal according to claim 1, wherein the latching pawls are provided respectively in leading end portions of the elastic arms.

3. The ground terminal according to claim 1, wherein at least one projection is provided in the inner circumferential edge of the central coupling portion.

4. The ground terminal according to claim 1, wherein the slit extends to both ends of the central coupling portion.

5. The ground terminal according to claim 1, wherein the projection is curved.

6. The ground terminal according to claim 1, wherein a continuous arc is formed by the inner circumferential edges of the central coupling portion and the elastic arms.

7. The ground terminal according to claim 1, wherein the elastic arms adjacent to each other differ from each other in length.

8. The ground terminal according to claim 1, wherein the pair of latching pawls is provided in the inner circumferential edge of the central coupling portion, the latching pawls being opposed to each other.

9. A connector, comprising:

the ground terminal according to claim 1.

10. The connector according to claim 9, wherein the central coupling portion and the elastic arms of the ground terminal are inserted and prevented from disengagement in an engagement groove having a substantial U-shape in section, the engagement groove being formed along an outer circumferential end face of a guard portion disposed on one end side of a connector body.

11. The connector according to claim 10, wherein a latch receiving portion is provided in a bottom surface of the engagement groove, the latch receiving portion being able to be latched in the latching pawl of the ground terminal.

12. The connector according to claim 10, wherein a notch is provided in the guard portion of the connector body, the notch being able to engage with a terminal portion of the ground terminal.

13. The ground terminal according to claim 6, wherein the elastic arms adjacent to each other differ from each other in length.

14. The ground terminal according to claim 6, wherein the pair of latching pawls is provided in the inner circumferential edge of the central coupling portion, the latching pawls being opposed to each other.

15. The ground terminal according to claim 7, wherein the pair of latching pawls is provided in the inner circumferential edge of the central coupling portion, the latching pawls being opposed to each other.

16. The ground terminal according to claim 4, wherein the pair of latching pawls is provided in the inner circumferential edge of the central coupling portion, the latching pawls being opposed to each other.

* * * * *